United States Patent [19]

Harrison et al.

[11] Patent Number: 4,810,409

[45] Date of Patent: Mar. 7, 1989

[54] STABLE, ISOTROPIC LIQUID LAUNDRY DETERGENTS

[75] Inventors: Kenneth A. Harrison, Monsey, N.Y.; Jeanne M. Weller, Glen Rock, N.J.

[73] Assignee: Sterling Drug Inc., New York, N.Y.

[21] Appl. No.: 133,833

[22] Filed: Dec. 16, 1987

[51] Int. Cl.[4] ..... C11D 1/86; C11D 3/20; C11D 3/42; C11D 17/08

[52] U.S. Cl. ..... 252/102; 252/174.21; 252/174.22; 252/301.21; 252/543; 252/547; 252/551; 252/DIG. 14

[58] Field of Search ..... 252/547, 528, 551, 532, 252/174.21, 174.22, DIG. 14

[56] References Cited

U.S. PATENT DOCUMENTS

| | | | |
|---|---|---|---|
| 3,932,316 | 1/1976 | Sagel et al. | 252/532 |
| 4,058,489 | 11/1977 | Hellsten | 252/547 |
| 4,132,678 | 1/1979 | Iijima et al. | 252/545 |
| 4,233,167 | 11/1980 | Sramek | 252/8.75 |
| 4,235,759 | 11/1980 | Ohbu et al. | 252/545 |
| 4,264,457 | 4/1981 | Becks | 252/8.75 |
| 4,302,364 | 11/1981 | Gosset et al. | 252/545 |
| 4,321,165 | 3/1982 | Smith et al. | 252/528 |
| 4,333,862 | 6/1982 | Smith | 252/547 |
| 4,382,008 | 5/1983 | Boreland et al. | 252/75 |
| 4,446,042 | 5/1984 | Leslie | 252/102 |
| 4,447,343 | 5/1984 | May et al. | 252/8.75 |
| 4,561,998 | 12/1985 | Wertz | 252/547 |
| 4,562,002 | 12/1985 | Neiditch et al. | 252/8.75 |

FOREIGN PATENT DOCUMENTS

| | | |
|---|---|---|
| 0818419 | 7/1969 | Canada . |
| 0641297 | 2/1948 | United Kingdom . |
| 0873214 | 11/1959 | United Kingdom . |

*Primary Examiner*—Paul Lieberman
*Assistant Examiner*—Kathleen Markowski
*Attorney, Agent, or Firm*—William G. Webb; Paul E. Dupont

[57] ABSTRACT

Stable, isotropic, liquid laundry detergents with good detergency, effective microbicidal and low irritancy properties comprising anionic, nonionic and cationic surfactants and an alkali metal benzoate in an aqueous vehicle.

12 Claims, No Drawings

STABLE, ISOTROPIC LIQUID LAUNDRY DETERGENTS

BACKGROUND OF THE INVENTION

This invention relates to stable, clear, liquid laundry detergent compositions containing an anionic surfactant and/or an anionic optical brightener, a cationic surfactant, a nonionic surfactant and sodium benzoate in an aqueous medium.

INFORMATION DISCLOSURE STATEMENT

Sagel et al. U.S. Pat. No. 3,932,316 discloses free flowing detergent compositions containing water soluble benzoate salts as anti-caking aids.

Helsten U.S. Pat. No. 4,058,489, in describing the prior art, states that it is known that adsorption of cationic softening agents onto cellulose "is reduced if the charge ratio of the anionic compound to the cationic compound is equal to or greater than 1" and "in order to obtain a good softening effect in a detergent composition, a charge ratio of less than 1 is required". The patentee also states that the use of such relative amounts of anionic:cationic agents is "the opposite of the ratio required for good washing effectiveness, which is equal to or greater than 1". Helsten, in describing his own invention, discloses detergent compositions containing (a) from 30 to 90 weight percent of a nonionic or amphoteric surfactant or mixtures thereof in combination with (b) from 10 to 70 weight percent of a surfactant mixture comprising at least one anionic surfactant and at least one cationic surfactant in a charge ratio of anionic:cationic in the range from about 0.6:1 to about 0.90:1, suitably from 0.70:1 to 0.95:1 and preferably from 0.75:1 to about 0.90:1. The combination is said to provide good softening, due to adsorption of the cationic surfactant on the textile fibers, and good cleansing properties which are provided by the nonionic surfactant.

Iijima et al. U.S. Pat. No. 4,132,678 discloses transparent liquid shampoo compositions containing as "critical components" from 10–40% by weight of an anionic surface active agent of the formula:

$$R_1—O—(CH_2CH_2O)_nSO_3M$$

"wherein $R_1$ is alkyl having 10 to 18, preferably 12 to 14, carbon atoms, n is the average mole number of added ethylene oxide units and is in the range from 1 to 5 on the average, preferably 2–4 with the proviso that the content of compounds in which n=0 is not higher than 5%, preferably less than about 4%, and M is an alkali metal such as sodium and potassium or an organic amine such as mono-, di- or tri-ethanolamine"
and from 0.1–5% of a cationic surface active agent of the formula:

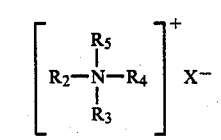

"wherein $R_2$ is an alkyl group having 16 to 22 carbon atoms, $R_3$ and $R_4$ are alkyls having 1 or 2 carbon atoms, preferably methyl, $R_5$ is alkyl having 1 to 2 carbon atoms, preferably methyl, or benzyl, and x is an anionic group such as a halogen atom, e.g., Cl, Br or I, or a monoethyl sulfate group." The patentee states that if the content of the anionic surfactant (when n=0) exceeds 5%, the cationic "cannot be dissolved to form a transparent solution, and precipitation of crystals occurs at low temperature."

Sramek U.S. Pat. No. 4,233,167 discloses liquid softening and brightening compositions comprising a water soluble nonionic surfactant, a quaternary ammonium fabric softener, a stilbene disulfonic acid type optical brightener, a hydrotrope to assist in solubilizing the ingredients, such as sodium salts of fatty acids and aralkyl sulfonic acids, in an aqueous medium.

Ohbu et al. U.S. Pat. No. 4,235,759 discloses liquid detergent compositions comprising an anionic surface active agent of the formula:

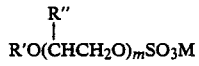

and a quaternary ammonium salt of the formula:

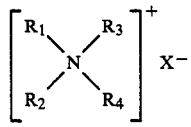

where the ratio of the anionic:quaternary is in the range from 8:1 to 1:1 and:
"wherein R′ represents alkyl radical having 8 to 16 carbon atoms, R″ represents H or $CH_3$, m represents an average number of mols of alkylene oxide added which is in the range of from 1 to 6, M represents alkali metal, ammonium or organic amine, $R_1$ represents alkyl radical having 8 to 14 carbom atom, $R_2$ and $R_3$ represent $CH_3$, $C_2H_4OH$ or $(C_2H_4O)_2H$, $R_4$ represents $CH_3$, $C_2H_4OH$, $(C_2H_4O)_2H$ or benzyl radical, and X represents halogen $CH_3$ $SO_4$ or $C_2H_5SO_4$."

The patentees state that, in the practice of their invention, the two ingredients are prevented from forming a "mixed micellelike complex as a result of electrostatic coupling" by use of a specific range of molar ratios of the anionic and cationic surfactants.

Beeks et al. U.S. Pat. No. 4,264,457 discloses liquid laundry detergents and fabric softeners which are said to be "clear" comprising "the following specific three classes of components in critical proportions", namely from 3–35% of a nonionic surfactant of the polyethoxylated alkyl or phenyl ether type, about 3–30% of a mono-long chain cationic surfactant selected from two structural groups and an anionic surfactant consisting of a mixture of two different anionic surfactants, one being a $C_4$–$C_{10}$ alcohol sulfate and the other a $C_{12}$–$C_{22}$ alcohol ethoxylated ether sulfate or carboxylate having from 1 to 15 moles of ethylene oxide per molecule Gosset et al. U.S. Pat. No. 4,302,364 discloses homogeneous, liquid, builder free, heavy duty laundry detergent compositions comprising (a) from 35 to 65 weight percent of a ternary surfactant mixture containing (i) from 50–70 weight percent of an anionic surfactant; (ii) from 15–47 weight percent of an ethoxylated nonionic surfactant; and (iii) from 3–15 weight percent of a cationic surfactant, the weights being expressed relative to the sum of the ingredients in the ternary mixture; and (b) a solvent comprising water and a compatible organic solvent. The predominant ingredient in the compositions is thus the anionic surfactant, and the patentee states that the cationic must be used at no more than 15 weight percent. Otherwise, if the compositions contain less than 50 weight percent of the anionic or more than 15 weight percent of the cationic, the compositions become unstable and undergo phase separation, or they are incompatible with other ingredients added to the compositions, or they cause processing problems in the preparation of the compositions.

Smith et al. U.S. Pat. No. 4,321,165 discloses a solid particulate detergent composition comprising a surfactant system consisting essentially of a water-soluble or dispersible combination of anionic, alkoxylated nonionic and water-soluble quaternary ammonium cationic surfactants and a detergency builder.

Smith et al. U.S. Pat. No. 4,333,862 discloses detergent compositions comprising a mixture of (a) from 15-45% of an anionic surfactant; (b) a water soluble quaternary ammonium cationic surfactant in a ratio of anionic:cationic of less than 5:1; and (c) a nonionic surfactant of the formula $RO(C_2H_4O)_nH$ where R is primary or secondary, branched or unbranched $C_8$–$C_{24}$ alkyl or alkenyl or $C_6$–$C_{12}$ alkylphenyl, and n is from 2 to 9, and wherein the ratio of nonionic: cationic surfactant is from 5:1 to 2:3. The cation of the cationic surfactant has the formula:

$$R^1{}_mR^2{}_xN^+$$

"wherein each $R^1$ is a hydrophobic alkyl or alkenyl group optionally substituted or interrupted by phenyl, ether, ester or amide groups totalling from 8 to 20 carbon atoms and which may additionally contain up to 20 ethoxy groups, m is a number from 1 to 3 and no more than one $R^1$ can have more than 16 carbon atoms when m is 2 and no more than 12 carbon atoms when m is 3, each $R^2$ is an alkyl or hydroxyalkyl group containing from one to four carbon atom or a benzyl group with no more than one $R^2$ in a molecule being benzyl, x is from 0 to 3 and the sum of m and x is no more than 4."

The patentee also states that sodium benzoate can be added as an anti-caking agent.

Boreland et al. U.S. Pat. No. 4,382,008 discloses corrosion inhibitors comprising a triazole, an alkali metal borate, an alkali metal benzoate, an alkali metal silicate and an alkali metal salt of a dibasic organic acid.

Leslie U.S. Pat. No. 4,446,042 discloses laundry detergent compositions comprising a surfactant mixture consisting essentially of: an ethoxylated alcohol or ethoxylated alkyl phenol nonionic surfactant of the formula $R(OC_2H_4)_nOH$, where R is a $C_{10}$–$C_{18}$ aliphatic hydrocarbon radical or an alkylphenyl radical in which the alkyl group contains from 8 to 15 carbon atoms, n is from 2–9, a quaternary ammonium cationic surfactant "having 2 chains which each contain an average of from about 12 to about 22 carbon atoms" and an anionic brightener of the stilbene disulfonic acid class.

May et al. U.S. Pat. No. 4,447,343 discloses concentrated fabric softeners comprising a quaternary ammonium salt, an anionic surfactant, a nonionic dispersant, a $C_1$–$C_3$ alcohol, water and optional non-essential ingredients.

Neiditch et al. U.S. Pat. No. 4,562,002 discloses homogeneous fabric softening compositions comprising a cationic surfactant, a stilbene disulfonic acid fluorescent brightening agent, a "non-ionizable base" and water.

British Patent No. 641,297 discloses germicidal detergent compositions comprising a mixture of anionic, cationic and nonionic detergents, and the patentee states that anionic and cationic surfactants usually form inhomogeneous and cloudy mixtures which separate into layers or which form precipitates. In addition it is stated that in such mixtures the detergent power is diminished noticeably lower than that ordinarily provided by the anionic detergent and that the germicidal power of the cationic agent is adversely affected by the anionic detergent. The patentee solves the problem by addition of a "small amount" of a nonionic surfactant to a mixture of a cationic germicide and an anionic detergent to produce mixtures that are stable and that have good germicidal and detergent properties. The relative proportions of the anionic and cationic agents can be varied over a wide range, and the relative amounts chosen will depend in large measure on the specific compounds used and on the specific use for which the composition is intended, but the relative proportions of anionic:cationic are usually in the range from 1:4 to 12:1. Turbidity is said to be pronounced at a stoichiometric ratio of 1:1 and can be overcome by incorporation of about 10 percent by weight of a nonionic surfactant based on the combined weight of the anionic and cationic ingredients.

British Patent No. 873,214 discloses detergent compositions, which are particularly useful in washing hydrophobic synthetic fibers, such as nylon, containing anionic, nonionic and cationic surfactants. The compositions contain, by weight, from 51 to 98½ percent nonionic surfactant, from 1 to 48 percent of a cationic surfactant and from ½ to 24 percent of an anionic surfactant. The patentee states that the cationic agent is always present in stoichiometric excess over the anionic agent because the cationic and anionic agents form a complex which has an affinity for the hydrophobic fibers and bonds thereto to provide a rinse resistant antistatic effect.

Canadian Patent No. 818,419 discloses textile detergents useful in the washing cycle of a laundry operation to wash and soften textiles simultaneously, which are said to have both good detergent and fabric softening properties. The compositions comprise (a) an electroneutral complex comprising stoichiometric amounts of a cationic textile softening agent and an anionic surfactant and (b) a cationic-nonionic dispersing mixture which serves to effect dispersion of the un-ionized, insoluble electroneutral complex. The cationic-nonionic dispersing agent is a mixture of cationic and nonionic surfactants, and in the absence of the nonionic, the composition will neither wash nor soften textiles, and in the absence of the cationic, it will not soften them. The cationic and nonionic materials making up the dispersing mixture are present in a mole ratio of between 0.001:1 and 5:1 and preferably from 0.01:1 to 1:1.

German OLS No. 1,954,292 discloses detergent compositions containing a combination of nonionic, cationic and anionic surfactants of which at least 50 percent of the nonionic is an amine oxide and the anionic detergent comprises at most 54% of the composition. The charge ratio of the anionic to the cationic surfactants is stated to be at most 0.54:1.

German OLS No. 2,433,079 discloses detergent and fabric conditioner compositions containing from 10 to 45 percent of a phosphate builder, from 5 to 20 percent of an anionic detergent, from 1 to 10 percent of a nonionic detergent and from 2 to 10% of a quaternary ammonium conditioner for simultaneously washing and conditioning fabrics. Maximum soil removal is produced with a detergent mixture containing 3.75% nonionic, 12% anionic and 5% cationic. The nonionic detergent is said to increase the solubility of both the anionic and the cationic agents. The most important constituent however is said to be the anionic agent which is always present in substantial excess relative to the cationic.

Thus it is seen that the prior art is either silent on the problem of overcoming the stability and phase separation problems encountered in detergent compositions containing both an anionic and a cationic surfactant, or the prior art has attempted to solve the problem in a variety of ways, including the use of a large ratio of anionic:cationic surfactants (Helsten, Ohbu, Gosset, Smith et al. No. 4,333,862, German No. 1,954,292 and German No. 2,433,079), minimizing the amount of anionic surfactant without the addition of other ingredients to correct the stability problem (Iijima), the use of hydrotropes (Sramek), the use of a small amount of a nonionic (British No. 641,297) or the use of a large excess of a nonionic surfactant (British No. 873,214 and Canadian No. 818,419). The prior art does not teach whether those solutions achieved only limited objectives, such as good detergency or good softening properties, or whether such limited objectives were achieved at the expense of other potential worthwhile objectives such as retention of good microbicidal effectiveness or low irritancy. We have found that, by use of a combination of anionic, cationic and nonionic surfactants and an alkali metal benzoate in certain critical proportions, stable, liquid laundry detergent compositions are produced which not only possess good detergency but also possess very effective microbicidal activity and low eye irritancy.

SUMMARY OF THE INVENTION

In a composition aspect, the invention resides in stable, isotropic liquid laundry detergent compositions comprising (A) an anionic surfactant and, optionally, an anionic brightener; (B) a cationic surfactant of the quaternary ammonium class; (C) a nonionic surfactant; (D) an alkali metal benzoate; and (E) water.

DETAILED DESCRIPTION OF THE PREFERRED EMBODIMENTS

More specifically, and in accordance with the foregoing, the present invention relates to stable, isotropic, liquid laundry detergents with reduced eye irritancy and good microbicidal and detergency properties comprising: (A) an anionic surfactant of the polyethylene glycol long chain alkyl ether sulfate class having the formula:

$$R-(OCH_2CH_2)_m-OSO_3^- M^+ \qquad \text{I}$$

where R is straight or branched chain $C_{12}$–$C_{15}$ alkyl; m is an integer from 1 to 4 and $M^+$ is an alkali metal cation; (B) a cationic surfactant of the quaternary ammonium halide class having the formula:

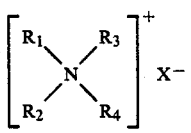

II where $R_1$ and $R_2$ are lower-alkyl groups containing from 1 to 3 carbon atoms; $R_3$ is $C_8$–$C_{16}$ alkyl; $R_4$ is $C_8$–$C_{16}$ alkyl or benzyl and $X^-$ is a halide anion, for example chloride, bromide or iodide; (C) one or more of a nonionic surfactant selected from the group consisting of a polyethylene glycol alkylphenyl ether having the formula:

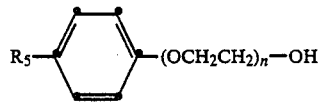

III where $R_5$ is $C_8$–$C_9$ straight branched chain alkyl, and n is an integer from 5 to 13 and a polyethylene glycol long chain alkyl ether having the formula:

$$R_6-(OCH_2CH_2)_n-OH \qquad \text{IV}$$

where $R_6$ is $C_9$–$C_{15}$ straight chain or secondary alkyl and n has the meanings given above; (D) an alkali metal benzoate; and (E) water and wherein the stoichiometric ratio of the anionic:cationic surfactants is in the range from about 0.05:1 to about 0.3:1.

The compositions may also optionally contain, either in combination with or in place of the anionic surfacetant, an anionic brightener of the stilbene disulfonic acid type disclosed in U.S. Pat. No. 3,193,548 having the formula

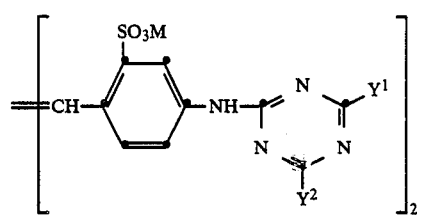

V where M is an alkali metal cation and $Y^1$ and $Y^2$ are hydroxyethoxyethylamino having the formula:

$$-NHCH_2CH_2-(OCH_2CH_2)_p-OH$$

where p is an integer from 0 to 3. A preferred brightener is the compound where M is sodium and p in the groups $Y_1$ and $Y_2$ is the integer 1 which is marketed by the Hilton-Davis Chemical Co., Cincinnati, Ohio as Hiltamine Artic White TX.

It has been found that when the above ingredients are mixed together in certain critical amounts relative to one another, stable, isotropic, i.e. optically clear, liquid laundry detergent compositions are produced which are characterized by good detergency, effective microbicidal activity, as the term "effective" is defined by EPA protocols to be described hereinbelow, and low eye irritancy.

Thus the compositions of the invention can be more specifically described as comprising: (A) from about 0.2 to about 3 percent of an anionic surfactant of Formula I; (B) from about 3.8 to 7 percent of a cationic surfactant of Formula II; (C) from about 7 to about 30 percent of a nonionic surfactant of Formulas III and/or IV; (D) from about 1 to about 6 percent of an alkali metal benzoate, optionally from about 0.1 to about 0.5 percent of an anionic brightener of Formula V; and (E) water, the percentages being in percent by weight of the various ingredients in the total weight of the composition, and wherein the stoichlometric ratio of the total anionic:cationic surfactants and brightener is in the range from about 0.05:1 to about 0.3:1.

The relative amounts of the anionic ingredients, i.e. the anionic surfactant and the anionic brightener, the cationic surfactant, the nonionic surfactant and the alkali metal benzoate are critical because, to begin with and as is well known, when anionic and cationic surfactants or anionic brighteners and cationic surfactants are mixed together in water, they usually form an insoluble complex and produce cloudy, multi-phase systems. That problem is obviated in the present invention, in part, by use of a critical ratio of the anionic surfactant-/anionic brightener: cationic surfactant. Moreover, we have found that if high ratios of anionic surfactant/anionic brightener:cationic surfactants are used, the microbicidal activity of the composition is diminished with increase in the amount of the anionic ingredients relative to the cationic surfactant. Accordingly, in the present invention the insolubility problem caused by admixture of the anionic and cationic agents is avoided while maintaining the antibacterial activity of the cationic agent, by use of critical stoichiometric ratios of anionic:cationic agents in the range from about 0.05:1 to about 0.3:1 and by use of an alkali metal benzoate in the range from about 0.8:1 to about 2:1 relative to the cationic agent and a nonionic surfactant in the amounts stated above. Preferred compositions are prepared using from about 2 to about 3 weight percent of the anionic agents, from about 6 to about 7 weight percent of the cationic agents, around 12 weight percent of the nonionic surfactant, a ratio of alkali metal benzoate:cationic agent of about 1:1 and a ratio of combined anionics:cationic surfactant, i.e. anionic surfactant+anionic brightener:cationic surfactant, of around 0.3:1.

The anionic surfactant serves to diminish the eye irritancy problems inherent in the cationic surfactants and also to improve the detergency properties of the compositions.

The amount of nonionic surfactant in the compositions is chosen so as to optimize the stability of the compositions and also, together with the anionic surfactant, to provide the desirable detergency properties. We have found good stability and detergency are obtained by use of around 12 weight percent of the nonionic surfactant, and, as stated before, that is a particularly preferred amount thereof.

The anionic surfactants of Formula I are a well known class of compounds and are readily available in commerce. For example the compounds where R is $C_{12}$–$C_{15}$ alkyl and m has an average value between 1 and 4, where R is $C_{12}$–$C_{13}$ alkyl and m has an average value between 1 and 4 and where R is $C_{12}$ alkyl and m has an average value between 1 and 4 are sold under the respective Shell Chemical Co. (Houston, Texas) tradename NEODOL® 25-3S (identified by the CTFA adopted name sodium pareth-25 sulfate), Chem-Y Fabriek van Chemische Producten, B.V. (Bodegraven, Netherlands) tradename AKYPOSAL DS-56 (identified by the CTFA adopted name sodium pareth-23 sulfate) and Henkel, Inc. (Teaneck, New Jersey) tradename STANDOPOL® ES-1 (identified by the CTFA adopted name sodium laureth sulfate).

The di-(lower-alkyl)-long-chain-alkylbenzylammonium halides and the di-(lower-alkyl)-di-(long-chain-alkyl)ammonium halides of Formula II are also well known classes of compounds. The di-(lower-alkyl)-long-chain-alkylbenzylammonium halides include, for example, benzalkonium chloride (dimethylalkylbenzylammonium chloride) sold under the tradename CYNCAL® 80 by The Hilton-Davis Chemical Co., Cincinnati, Ohio, which consists of 80% by weight of alkyldimethylbenzylammonium chloride (50% $C_{14}$, 40% $C_{12}$ and 10% $C_{16}$ alkyl), 10% water and 10% ethanol, and myristalkonium chloride (dimethylmyristylbenzylammonium chloride), sold under the tradename BARQUAT® MS-100 by Lonza Inc., Fairlawn, New Jersey.

The di-(lower-alkyl)-di-(long-chain-alkyl)ammonium halides of Formula II above, where $R_1$ and $R_2$ are lower-alkyl, $R_3$ and $R_4$ are both $C_8$–$C_{16}$ alkyl and $X^-$ is halide, include, for example, decyldimethyloctylammonium chloride and didecyldimethylammonium chloride, sold under the tradenames BARDAC® 2050 and BARDAC® 2250, respectively, by Lonza Inc.

The polyethylene glycol alkylphenyl ethers of Formula III are also well known in commerce, examples thereof being sold under the Rohm and Haas (Philadelphia, Pennsylvania) tradenames TRITON® X and TRITON® N or the GAF Corporation (Wayne, New Jersey) tradenames IGEPAL® CA and IGEPAL® CO, and are identified by the CTFA adopted names of octoxynols and nonoxynols. These include, for example, octoxynol-7, octoxynol-10 and octoxynol-13 where $R_5$ in Formula III is $CH_3C(CH_3(CH_3)_2$- and n has an average value of 7, 10 and 13, respectively, and nonoxynol-7, nonoxynol-8, nonoxynol13, etc., where $R_5$ in Formula III is $C_9H_{19}$ and n has an average value of 7, 8 and 13, respectively.

The polyethylene glycol long chain alkyl ethers of Formula IV above are also commercially available. Examples thereof are sold under the Shell Chemical Co. (Houston, Texas) tradename NEODOL® 45 and are identified by the CTFA adopted name pareth-45. Suitable members of the group for the practice of the present invention are pareth-45-7, pareth45-11 and pareth-45-13, where $R_6$ in Formula IV is the residue of a mixture of synthetic $C_{14}$–$C_{15}$ alcohols and n has an average value of 7, 11 and 13, respectively.

The compositions may, in order to provide additional benefits, optionally contain non-essential ingredients such as fragrances, dyes, brighteners, other solvents, such as ethanol, or thickeners. Generally, fragrances may be used in amounts up to about 1.0 weight percent, dyes in amounts up to about 0.01 weight percent; brighteners in amounts up to about 0.6 weight percent; ethanol in amounts up to about 10 weight percent; and thickeners in amounts up to about 2.0 weight percent.

Although the precise order of mixing the various ingredients in the compositions is not critical, they are conveniently prepared by sequential addition to water, with stirring at ambient temperature, of the anionic surfactant, followed in order by the nonionic surfactant, the sodium benzoate, the quaternary ammonium halide and then the dyes, fragrances, brighteners, hydrotropes or thickeners, stirring being continued at each step to effect homogeneous dispersion of each ingredient.

The laundry detergent compositions of the invention are formulated as liquid concentrates. In use the concentrate is added to the wash water in such amounts as to provide good cleaning and sanitization. It has been found that about ½ cup (about 4 ounces) of concentrate per wash load (or about 4 ounces per 16 gallons), which provides a use dilution of about 1:500, is adequate for such purposes.

The manner and process of making and using the invention, and the best mode contemplated by the inventors for carrying out the invention, will now be described so as to enable the person skilled in the art to which it pertains to make and to use the same.

EXAMPLES

Six formulations composed as shown in TABLE 1 below, and prepared as described above, were prepared for test purposes, the amounts of ingredients being expressed in weight percent of each ingredient based on actives. The number of moles of each of the principal ingredients, [i.e. the cationic agent (CYNCAL ®), the anionic surfactant (NEODOL ® 23-3S), the sodium benzoate, the nonionic surfactant (NEODOL ® 45-7) and the brightener]are given in the first column of each formulation, those values being based on average molecular weights for the CYNCAL ®, NEODOL ® 23-3S and NEODOL ® 45-7 of 359,427 and 539, respectively, as provided in manufacturer's literature for each of those products. The molar ratios for the anionic surfactant/anionic brightener:cationic surfactant and the sodium benzoate:cationic surfactant are given in the second column for each formulation.

TABLE 1

| | Formulation A | | Formulation B | | Formulation C | | Formulation D | | Formulation E | | Formulation F | |
|---|---|---|---|---|---|---|---|---|---|---|---|---|
| Ingredient | Wght. (moles) | Ratio | Wght. (moles) | Ratio | Wght. (moles) | Ratio | Wght. (moles) | Ratio | Wght. (moles) | Ratio | Wght. (moles) | Ratio |
| CYNCAL ® | 6.4 (0.018) | — | 6.4 (0.018) | — | 6.4 (0.018) | — | 6.4 (0.018) | — | 6.4 (0.018) | — | 6.4 (0.018) | — |
| NEODOL ® 23-3S | 2.2 (0.0052) | 0.29:1 | 0.4 (0.00094) | 0.05:1 | 4.4 (0.010) | 0.56:1 | 7.8 (0.018) | 1:1 | — | 0:1 | — | 0:1 |
| sodium benzoate | 2.0 (0.014) | 0.78:1 | 4.0 (0.028) | 1.54:1 | 4.0 (0.028) | 1.54:1 | 4 (0.028) | 154.1:1 | 4 (0.028) | 154.4:1 | — | 0:1 |
| NEODOL ® 45-7 | 12.0 (0.022) | — | 12.0 (0.022) | — | 12.0 (0.022) | — | 12 (0.022) | — | 12 (0.022) | — | 12 (0.022)[b] | — |
| sodium xylenesulfonate | 2.0 | — | — | — | — | — | — | — | — | — | — | — |
| Glycerin | 2 | — | — | — | — | — | — | — | — | — | — | — |
| Brightener[a] | 0.6 (0.00061) | 0.033:1 | 0.3 (0.0003) | 0.017:1 | 0.3 (0.0003) | 0.017:1 | 0.3 (0.0003) | 0.017:1 | 0.3 (0.0003) | 0.017:1 | 0.3 | — |
| Fragrance | 0.5 | — | 0.5 | — | 0.5 | — | 0.5 | — | 0.5 | — | 0.5 | — |
| Dye | 0.005 | — | 0.005 | — | 0.005 | — | 0.005 | — | 0.005 | — | 0.005 | — |
| Water | q.s. | — | q.s. | — | q.s. | — | q.s. | — | q.s. | — | q.s. | — |

[a]Hiltamine Arctic White TX (Hilton-Davis Chemical Co., Cincinnati, Ohio)-molecular weight 984.58
[b]Nonionic used was NEODOL ® 23-6.5 (pareth-23-6.5)

Formulations A and B are formulated in accordance with the invention as described above and are within the ambit of the invention, whereas formulations C, D, E and F were prepared for comparative purposes and are outside the scope of the invention.

The formulations of the invention and the comparative formulations were tested for cleaning efficacy employing EMPA and Krefeld standard soiled fabrics; for germicidal activity against *K. pneumoniae* ATCC 4352 and *S. aureus* ATCC 6538 using the EPA-approved Petrocci-Clark test procedure [Proposed Test Method for Antimicrobial Laundry Additives, Petrocci and Clark, J. Assoc. Off. Anal. Chem. 52(4), 836–842 (1969)]which is a simulated in-use test method (see EPA Publication DIS/TSS-13, May 2, 1979); and for eye irritation in rabbits using the standard FIFRA method (described at 40 C.F.R. 163.81-4).

The detergency tests used in the present study are described in U.S. Pat. No. 4,576,729 except that the temperature of the wash and rinse water was 105° F. instead of 120°–130° F. In the test using standard EMPA soiled fabrics (prepared by the Swiss Federal Testing Station in Switzerland), the standard soil is an India ink and olive oil emulsion (an oily type soil), and in the test using standard Krefeld soiled fabrics (prepared by the Wascherei Forschungs Institute of Krefeld, West Germany), the soil is 84% clay, 8% lamp black, 4% black iron oxide and 2% yellow iron oxide oversprayed with a solution of 3.4% lanolin dissolved in carbon tetrachloride and salt solution (the salt to simulate human perspiration). The cleaning efficacy, expressed as % Soil Removal, was calculated in each test procedure for the test swatches as follows, the values obtained for any given detergent formulation being the average of the individual values so determined:

$$\% \text{ Soil Removal} = \frac{R_w - R_s}{R_o - R_s} \times 100$$

$$\% \text{ Soil Redeposition} = \frac{R_o - R_{ow}}{R_o - R_s} \times 100$$

where:

$R_w$=Average reflectance of washed soiled cloths $R_s$=Average reflectance of unwashed soiled cloths $R_o$=Average reflectance of unsoiled cloths before washing $R_{ow}$=Average reflectance of unsoiled cloths after washing with soiled cloths Thus the higher the value for % Soil Removal, the greater the detergency, and the lower the value for % Soil Redeposition, the better the soil redeposition properties.

In the germicidal activity test, EPA protocols require a germ reduction of at least 99.90% for laundry sanitizers against the two test organisms, *K. pneumoniae* and *S. aureus*. Compositions which meet that requirement for germ reduction are characterized as effective sanitizers, and those that fail to meet that requirement are characterized as ineffective sanitizers.

Eye irritation results are expressed in terms of the highest mean Draize scores in accordance with the standard FIFRA method.

The results obtained are set forth in TABLE 2 where EMPA and Krefeld detergency results are expressed in terms of % soil removal and % soil redeposition values; antimicrobial activity is expressed in terms of percent germ reduction and antimicrobial effectiveness based on the above-noted EPA protocols; and eye irritation is expressed in terms of Draize scores. The ratio of the anionic:cationic surfactants in each of the formulations is given in the column headed "Ratio".

TABLE 2

| Formulation | Ratio | Detergency | | Sanitization | | | | | Eye Irritation | |
|---|---|---|---|---|---|---|---|---|---|---|
| | | | | *K. pneumoniae* | | *S. aureus* | | | | |
| | | % S. Rem. | % S. Red. | Swatch | Water | Swatch | Water | Result | Washed | Unwashed |
| A | 0.29:1 | Krefeld 41.4 | 2.3 | 99.98 | 100 | 100 | 100 | pass | 22[a] | 34.7[a] |
| | | EMPA 32.8 | 1.2 | | | | | | | |
| B | 0.05:1 | Krefeld 26.1 | 9.1 | 99.9 | 100 | 100 | 100 | pass | N.T. | N.T. |
| | | EMPA 30.3 | 3.9 | | | | | | | |
| C | 0.56:1 | Krefeld 39.8 | 0.8 | 94.4 | 99.6 | 99.99 | 100 | fail | 16.7[b] | 36.8[c] |
| | | EMPA 31.1 | 1.5 | | | | | | | |
| D | 1:1 | Krefeld 28.3 | 0.6 | 89 | 91.5 | 96.7 | 100 | fail | N.T. | N.T. |
| | | EMPA 29.8 | 0.2 | | | | | | | |
| E | 0:1 | Krefeld 21.4 | 8.3 | 99.99 | 100 | 99.99 | 100 | pass | 68.7[c] | 103.4[c] |
| | | EMPA 27.3 | 5.0 | | | | | | | |
| F | 0:1 | Krefeld 7.9 | 2.9 | 99.99 | 100 | N.T. | N.T. | pass | 43.0[d] | 61.3[e] |
| | | EMPA 22.8 | 10.9 | | | | | | | |

[a]24 hours
[b]1 hour
[c]10 days
[d]3 days
[e]7 days

The soil removal test results show that good detergency is obtained in formulations where the anionic:cationic ratio is around 0.3:1 or lower, but detergent effectiveness diminishes both below a ratio of around 0.05:1 (Formulation B) and at ratios above around 0.3:1, i.e. Formulation C at a ratio of 0.56:1 and Formulation D at a ratio of 1:1. No clear picture emerges from the soil redeposition test results.

The sanitization tests show a very clear difference in microbicidal properties between compositions of the invention, both of which passed the EPA protocols, in which the ratio of anionic:cationic is around 0.3:1 or less, and Formulations C and D, in which the ratio is greater than 0.5:1. The good microbicidal activities shown by Formulations E and F, containing the same weight percent of cationic surfactant as Formulations A and B but no anionic surfactant, are not surprising in view of the presence of the cationic agent in those formulations. As noted above, and equally unsurprisingly, however, Formulations E and F showed poor detergency, and so the microbicidal effectiveness of those formulations was gained at the expense of good cleaning properties.

The eye irritation data indicate that compositions containing anionic and cationic surfactants in ratios from around 0.3:1 to around 0.6:1 are about equally irritating. A dramatic change in irritancy occurs, however, in compositions where no anionic surfactant at all is included in the compositions as in Formulations E and F.

We claim:

1. A stable, liquid laundry detergent composition comprising: (A) from about 0.2 to about 3.0 weight percent of an anionic surfactant having the formula:

$$R-(OCH_2CH_2)_m-OSO_3^- M^+ \qquad \text{I}$$

where R is $C_{12}$–$C_{15}$ alkyl; m is an integer from 1 to 4 and $M^+$ is an alkali metal cation; (B) from about 3.8 to about 7 weight percent of a cationic surfactant having the formula:

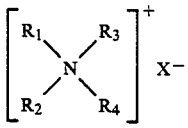

II where $R_1$ and $R_2$ are lower-alkyl groups containing from 1 to 3 carbon atoms; $R_3$ is $C_8$–$C_{16}$ alkyl; $R_4$ is $C_8$–$C_{16}$ alkyl or benzyl and $X^-$ is a halide anion; (C) from about 7 to about 30 weight percent of a nonionic surfactant selected from the group consisting of a compound having the formula:

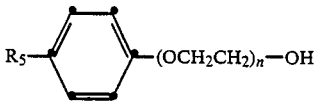

III where $R_5$ is $C_8$–$C_9$ straight or branched chain alkyl and n is an integer from 5 to 13 and a compound having the formula $$R_6-(OCH_2CH_2)_n-OH \qquad \text{IV}$$

where $R_6$ is $C_9$–$C_{15}$ straight chain or secondary alkyl and n has the meanings given above; (D) from about 1 to about 6 weight percent of an alkali metal benzoate; and (E) water and wherein the stoichiometric ratio of the anionic:cationic surfactants is in the range from about 0.05:1 to about 0.3:1.

2. A composition according to claim 1 which includes an anionic brightener having the formula

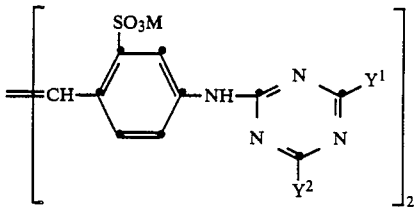

V where $Y^1$ and $Y^2$ are the group:

$$-NHCH_2CH_2-(OCH_2CH_2)_p-OH$$

where p is an integer from 0 to 3 and M is an alkali metal and wherein the stoichiometric ratio of the total anionic surfactant and anionic brightener:cationic surfactant is in the range from about 0.05:1 to about 0.3:1.

3. A composition according to claim 1 where $R_4$ in the cationic surfactant of Formula II is benzyl and the nonionic surfactant is a compound of Formula IV.

4. A composition according to claim 2 where $R_4$ in the cationic surfactant of Formula II is benzyl and the nonionic surfactant is a compound of Formula IV.

5. A composition according to claim 3 containing from about 2 to about 3 weight percent of the anionic surfactant, from about 6 to about 7 weight percent of the cationic surfactant and the ratio of the anionic to the cationic surfactants is about 0.3:1.

6. A composition according to claim 4 containing from about 2 to about 3 weight percent of the anionic surfactant, from about 6 to about 7 weight percent of the cationic surfactant and the ratio of the anionic to the cationic surfactants is about 0.3:1.

7. A composition according the claim 5 where the ratio of the alkali metal benzoate to the cationic surfactant is about 1:1.

8. A composition according to claim 6 where the ratio of the alkali metal benzoate to the cationic surfactant is about 1:1.

9. A composition according to claim 7 where the anionic, cationic and nonionic surfactants are a compound of formula I where R is $C_{12}$–$C_{13}$ alkyl, m has an average value from 1 to 4, and $M^+$ is the sodium ion; benzalkonium chloride and a compound of formula IV where $R^6$ is $C_{14}$–$C_{15}$ alkyl, and n has an average value of 7, respectively.

10. A composition according to claim 8 where the anionic, cationic and nonionic surfactants are a compound of formula I where R is $C_{12}$–$C_{13}$ alkyl, m has an average value from 1 to 4, and $M^+$ is the sodium ion; benzalkonium chloride and a compound of formula IV where $R_6$ is $C_{14}$–$C_{15}$ alkyl, and n has an average value of 7, respectively.

11. A composition according to claim 9 which includes an optical brightener, a fragrance, a dye and/or a hydrotrope.

12. A composition according to claim 10 which includes a fragrance, a dye and/or a hydrotrope.

* * * * *

UNITED STATES PATENT AND TRADEMARK OFFICE

CERTIFICATE OF CORRECTION

PATENT NO. : 4,810,409

DATED : March 7, 1989

INVENTOR(S) : Kenneth A. Harrison and Jeanne M. Weller

It is certified that error appears in the above-identified patent and that said Letters Patent is hereby corrected as shown below:

Column 6, line 10, change "straight branched" to read -- straight or branched -- and line 66, change "stoichlometric" to read -- stoichiometric --.

Column 8, line 24, change "$CH_3C(CH_3(CH_3)_2-$" to read -- $CH_3C(CH_3)_2CH_2C(CH_3)_2-$ --; line 27, change "nonoxynol13" to read -- nonoxynol-13 --; and line 36, change "pareth45-11" to read -- pareth-45-11 --.

Signed and Sealed this

Thirtieth Day of April, 1991

*Attest:*

*Attesting Officer*

HARRY F. MANBECK, JR.

*Commissioner of Patents and Trademarks*